US006045400A

United States Patent [19]

Detter

[11] Patent Number: 6,045,400

[45] Date of Patent: Apr. 4, 2000

[54] ELECTRICAL CONNECTOR AND CONNECTOR SLIDE-IN MOUNTING BRACKET ARRANGEMENT

[75] Inventor: Gary C. Detter, Berlin Center, Ohio

[73] Assignee: General Motors Corporation, Detroit, Mich.

[21] Appl. No.: 09/302,114

[22] Filed: Apr. 29, 1999

[51] Int. Cl.[7] ..... H01R 13/60

[52] U.S. Cl. ..... 439/532

[58] Field of Search ..... 439/532; 248/222.11, 248/223.41; 24/459, 702, 522; 403/11, 3, 532

[56] References Cited

U.S. PATENT DOCUMENTS

| | | | |
|---|---|---|---|
| 4,418,975 | 12/1983 | O'Keefe, II | 339/91 R |
| 5,192,227 | 3/1993 | Bales | 439/532 |
| 5,507,077 | 4/1996 | Kotajima | 24/669 |
| 5,817,975 | 10/1998 | Heilmann | 174/50 |

*Primary Examiner*—Neil Abrams
*Assistant Examiner*—Chandrika Prasad
*Attorney, Agent, or Firm*—Patrick M. Griffin

[57] ABSTRACT

An electrical connector and a slide-in connector mounting bracket are shaped to reduce the amount of sliding motion required to install the electrical connector in the connector mounting bracket.

12 Claims, 2 Drawing Sheets

ELECTRICAL CONNECTOR AND CONNECTOR SLIDE-IN MOUNTING BRACKET ARRANGEMENT

BACKGROUND OF THE INVENTION

This invention relates generally to electrical connectors and more particularly to an electrical connector and connector slide-in mounting bracket arrangement.

Electrical connectors are mounted on support panels by various types of connector mounting brackets. One general type of connector mounting bracket is a slide-in mounting bracket where the electrical connector body is equipped with lateral rails and the connector mounting bracket is equipped with complementary grooves or tracks that are open at one end. The electrical connector is installed in the connector mounting bracket by inserting the lateral rails into the open end of the grooves and sliding the electrical connector for the full length of the grooves into a fully installed and retained position. See for instance, U.S. Pat. No. 4,418,975 granted to John J. O'Keefe, II, Dec. 6, 1983.

SUMMARY OF THE INVENTION

The object of this invention is to provide an electrical connector and slide-in electrical connector mounting bracket arrangement that requires very little sliding motion for installation thereby reducing the time and effort required for mounting the electrical connector on a support panel.

A feature of the invention is that the lateral rails of the electrical connector are interrupted and the complementary grooves of the slide-in connector mounting bracket are interrupted by loading slots that allow insertion of the lateral rails laterally into the groove at an advanced location and thus reduce the amount of sliding motion required in conventional designs.

Another feature of the invention is that the lateral rails of the electrical connector are divided into a plurality of short lateral rails and that the grooves of the slide-in connector mounting bracket are interrupted by at least one pair of loading slots for receiving at least one pair of the short lateral rails laterally at an advanced location thereby reducing the amount of sliding motion required in conventional designs.

These and other objects, features and advantages of the invention will become more apparent from the following description of a preferred embodiment taken in conjunction with the accompanying drawing.

DESCRIPTION OF THE PREFERRED EMBODIMENT

Figure 1:
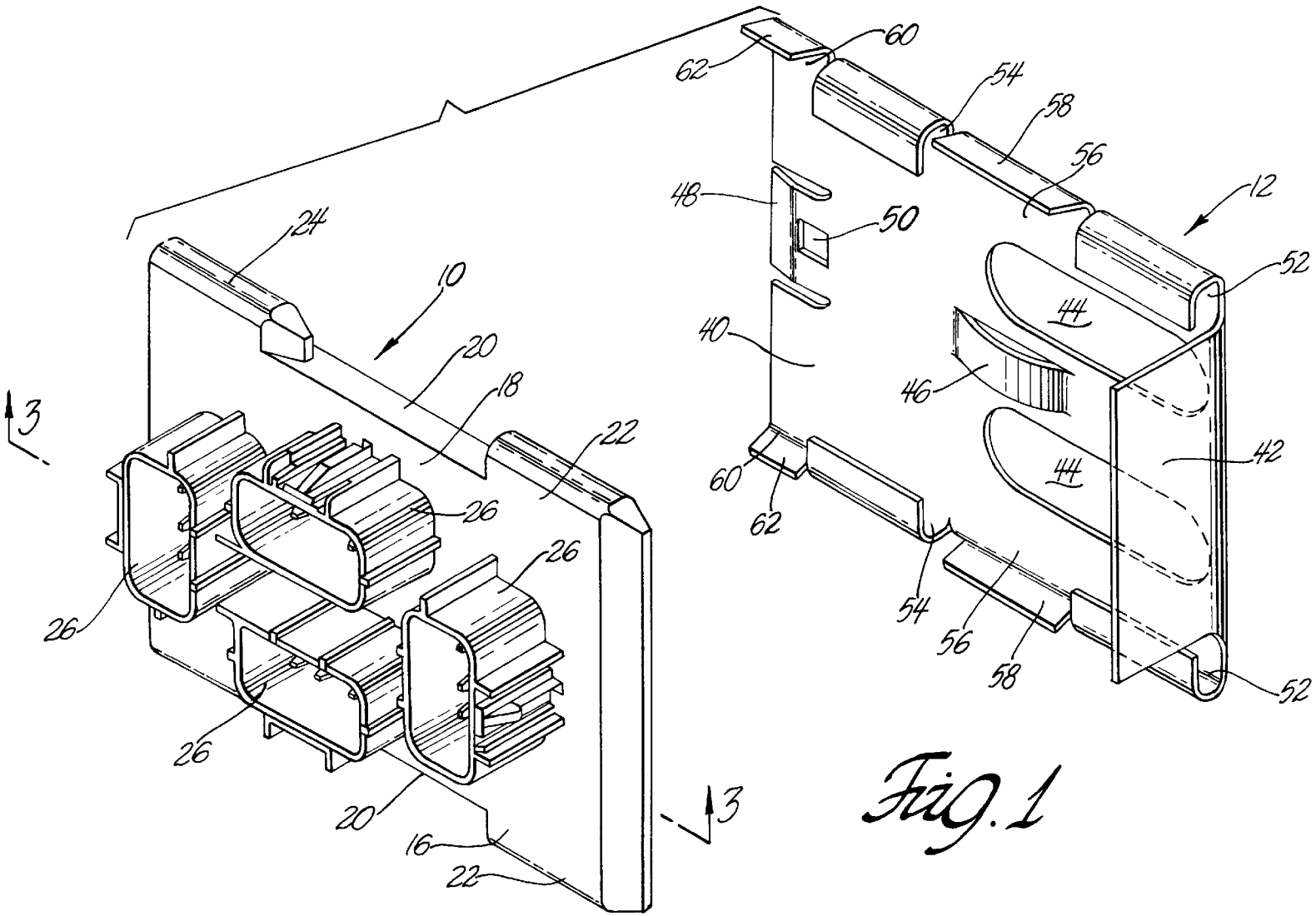
FIG. 1 is an exploded, perspective view of an electrical connector and connector mounting bracket arrangement of the invention.

Referring now to FIG. 1, there is shown an electrical connector 10 and a connector mounting bracket 12 that are designed for mounting the electrical connector 10 on a support panel such as an automotive body panel (not shown). Electrical connector 10 comprises a plurality of conductive electrical terminals 14 that are insert molded in a connector body 16 of insulator material. Connector body 16 includes a board 18 with side slots 20 that form a forward pair of lateral rails 22 and a rearward pair of lateral rails 24. The front edge of board 18 is tapered. This includes the front edges of the forward pair of lateral rails 22. The front edges of the rearward pair of lateral rails 24 are also tapered.

Figure 3:
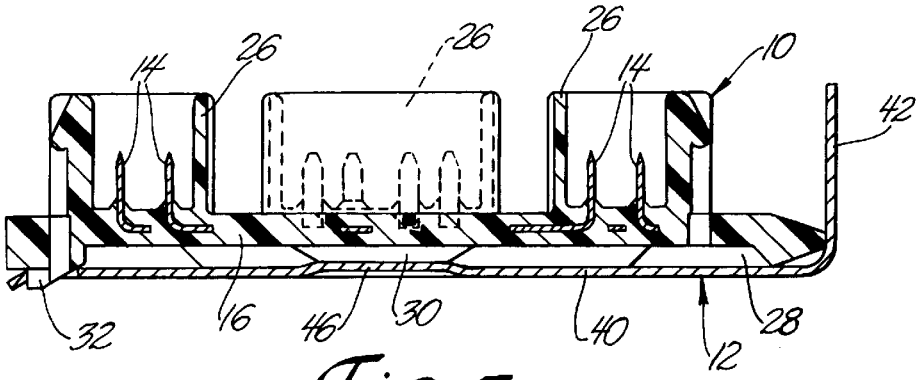
FIG. 3 is a longitudinal section of the electrical connector and connector mounting bracket arrangement taken substantially along the line 3—3 of FIG. 1 looking in the direction of the arrows.
Figure 4:
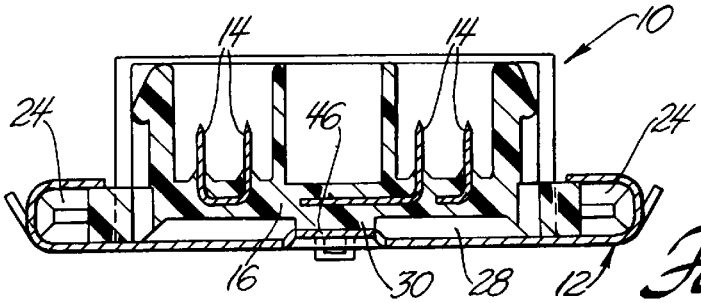
FIG. 4 is a transverse section of the electrical connector and connector mounting bracket arrangement taken substantially along the line 4—4 of FIG. 1 looking in the direction of the arrows.

Connector body 16 includes a plurality of integral sockets 26 that project from one face of board 18 and surround exposed contact ends of terminals 14 as best shown in FIGS. 3 and 4. The opposite face of board 18 has a large recess 28 that surrounds a dependent pad 30. Board 18 also has an integral lock nib 32 that projects from the opposite face as best shown in FIGS. 3, 4 and 5.

The connector mounting bracket 12 is made of sheet metal for economy. It has a sheet-like base 40 with an upright forward wall 42. The forward portion of base 40 has cut-outs 44 on either side of a resilient arch shaped tongue 46 that is formed by slitting and bending base 40. The rearward portion of base 40 is pierced to form a resilient lock arm 48 having a hole 50 for receiving lock nib 32.

The sheet-like base 40 has four integral conformations on each side edge. Forward L-shaped flanges that form inwardly facing grooves 52 and rearward L-shaped flanges that form inwardly facing grooves 54 are spaced apart to provide loading slots 56 between grooves 52 and 54. Loading slots 56 are at least as long as the forward pair of lateral rails 22 of connector body 16 including the tapered front edge. Base 40 preferably includes median wings 58 that slant into the respective loading slots 56 to guide the forward end of board 18 of connector body 16 into alignment with grooves 52 of connector mounting bracket 12. Base 40 also preferably includes short loading slots 60 behind rearward grooves 54 and rearward wings 62 to guide the rearward end of board 18 into alignment with grooves 54 of connector mounting bracket 12.

Figure 2:
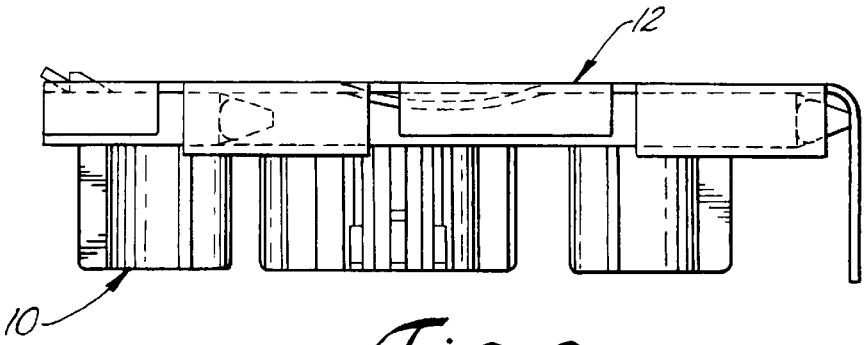
FIG. 2 is a side view of the electrical connector and connector mounting bracket arrangement that is shown in FIG. 1.
Figure 5:
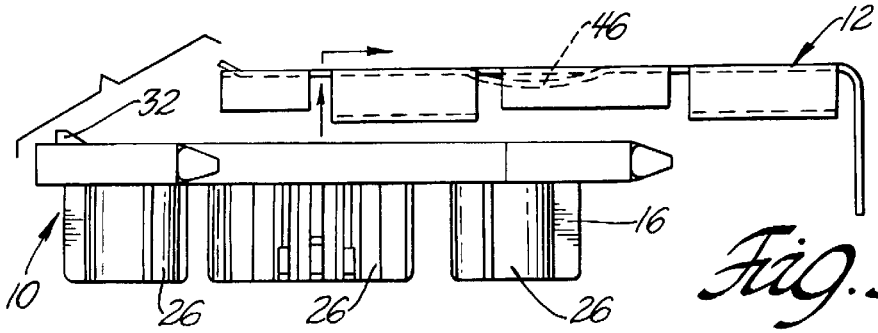
FIG. 5 is a side view of the electrical connector and electrical connector mounting bracket arrangement of FIG. 1 in the installation process.

Electrical connector 10 is installed in mounting bracket 12 by inserting the forward pair of lateral rails 22 into loading slots 56 in a perpendicular direction until board 18 bottoms out on base 40 as best indicated in FIG. 5. Electrical connector 10 is then slid forward in grooves 52 and 54 parallel to base 40 a short distance until the front edge of base 40 engages front wall 42 as best shown in FIGS. 2 and 3. Electrical connector 10 is now locked in the fully installed position by lock nib 32 engaging hole 50 of lock arm 48 as best shown in FIG. 3. Board 14 is biased away from base 40 by the resilient arch shaped tongue 46 engaging pad 30 as best shown in FIG. 3. This reduces and preferably prevents rattling.

Thus the electrical connector 10 is installed and locked into mounting bracket 12 firmly and rattle free with a very small sliding motion required. This saves time and installation cost.

Obviously, many modifications and variations of the present invention in light of the above teachings may be made. It is, therefore, to be understood that, within the scope of the appended claims, the invention may be practiced otherwise than as specifically described.

I claim:

1. A connector mounting bracket for an electrical connector having a connector body, the connector body having a front and a slot in each side that is spaced rearwardly of the front and that forms a front pair of lateral rails of a given length, the connector mounting bracket comprising:

a base having a forward pair of grooves and a rearward pair of grooves;

the rearward pair of inwardly facing grooves being spaced rearwardly of the forward pair of grooves by intervening loading slots, the loading slots having a length that is at least as great as the given length of the front pair of lateral rails of the connector body whereby the sliding motion for installing the connector body in the connector mounting bracket is reduced.

2. The connector mounting bracket as defined in claim 1 wherein the base has wings that slant into the respective loading slots to facilitate alignment of the front pair of lateral rails with the front pair of inwardly facing grooves.

3. The connector mount as defined in claim 2 wherein the base has an integral resilient tongue engaging the connector body to reduce rattling of the connector body in the connector mounting bracket.

4. The connector mounting bracket as defined in claim 3 wherein the base has an integral lock arm that engages an integral lock nib of the connector body for retaining the connector body in the mounting bracket.

5. A sheet metal connector mounting bracket for an electrical connector having a molded connector body board, the board having a front and a central slot in each side that is spaced rearwardly of the front and that forms a forward pair of lateral rails of a given length and a rearward pair of lateral rails, the connector mounting bracket comprising:

a base having a front wall, forward L-shaped portions at each side edge forming a forward pair of inwardly facing grooves and rearward L-shaped portions at each side edge forming a rearward pair of inwardly facing grooves, the rearward pair of inwardly facing grooves being spaced rearwardly of the forward pair of inwardly facing grooves by intervening loading slots, the intervening loading slots having a length that is at least as great as the given length of the forward pair of lateral rails of the connector body board for receiving a forward portion of the board during installation of the electrical connector to the connector mounting bracket, and the base having rearward loading slots rearward of the rearward pair of inwardly facing grooves for receiving a rearward portion of the board during installation of the electrical connector to the connector mounting bracket.

6. The sheet metal connector mounting bracket as defined in claim 5 wherein the base has median wings that slant into the respective intervening loading slots and rear wings that slant into the respective rearward loading slots for guiding the board into the loading slots and alignment with the respective pairs of inwardly facing grooves.

7. The sheet metal connector mounting bracket as defined in claim 6 wherein the base has an integral resilient tongue engaging the connector body board to reduce rattling of the connector body in the connector mounting bracket.

8. The sheet metal connector mounting bracket as defined in claim 7 wherein the base has an integral lock arm that engages a lock nib of the connector body for retaining the connector body in the connector mounting bracket.

9. The arrangement comprising:

an electrical connector having a molded connector body board, the connector body board having a front, a forward pair of lateral rails and a rearward pair of lateral rails that are spaced rearwardly of the forward pair of lateral rails by side slots in the connector body board, and a slide-in, sheet metal connector mounting bracket for the electrical connector having a sheet like base having a front wall, forward L-shaped portions at each side edge forming a forward pair of inwardly facing grooves and rearward L-shaped portions at each side edge forming a rearward pair of inwardly facing grooves, the rearward pair being spaced rearwardly of the forward pair by median loading slots, the median loading slots having a length that is sufficient for receiving a forward portion of the connector body board including the forward pair of lateral rails perpendicularly during installation of the electrical connector to the connector mounting bracket, and the base having median wings slanting into the respective loading slots for guiding the forward portion of the connector body board into the median loading slots during installation whereby the installation of connector body to the connector mounting bracket is completed by sliding the connector body board parallel to the base, a short distance.

10. The arrangement as defined in claim 9 wherein the slide-in electrical connector mounting bracket has rearward loading slots rearward of the rearward pair of inwardly facing grooves for receiving a rearward portion of the electrical connector board during installation of the electrical connector to the connector mounting bracket.

11. The arrangement as defined in claim 10 wherein the base has an integral resilient tongue engaging the board of the connector body to reduce rattling of the connector body in the connector mounting bracket.

12. The arrangement as defined in claim 11 wherein the base has an integral lock arm that engages a lock nib of the connector body for retaining the connector body in the mounting bracket.

* * * * *